US008120280B2

(12) United States Patent
Yi et al.

(10) Patent No.: US 8,120,280 B2
(45) Date of Patent: Feb. 21, 2012

(54) CIRCUITS AND METHODS FOR CONTROLLING A LIGHT SOURCE

(75) Inventors: Xinmin Yi, Chengdu (CN); Ching-Chuan Kuo, Taipei (TW); Jianping Wang, Chengdu (CN); Feng Shi, Chengdu (CN)

(73) Assignee: O2 Micro, Inc, Santa Clara, CA (US)

( * ) Notice: Subject to any disclaimer, the term of this patent is extended or adjusted under 35 U.S.C. 154(b) by 0 days.

(21) Appl. No.: 12/856,795

(22) Filed: Aug. 16, 2010

(65) Prior Publication Data

US 2011/0140621 A1 Jun. 16, 2011

(30) Foreign Application Priority Data

Jul. 2, 2010 (CN) ..... 2010 1 0225108

(51) Int. Cl.
*G05F 1/00* (2006.01)

(52) U.S. Cl. ..... 315/294; 315/297; 315/169.1; 315/209 R; 315/312; 345/102; 345/77; 345/204; 345/46; 345/92

(58) Field of Classification Search ..... 315/169.1, 315/169.3, 209 R, 185 R, 250, 291, 292, 315/294, 297, 312; 345/46, 82, 84, 87, 92, 345/77, 102, 204, 213, 690
See application file for complete search history.

(56) References Cited

U.S. PATENT DOCUMENTS

| | | | | |
|---|---|---|---|---|
| 6,808,287 | B2 * | 10/2004 | Lebens et al. | 362/184 |
| 7,126,289 | B2 | 10/2006 | Lin | |
| 7,317,403 | B2 * | 1/2008 | Grootes et al. | 340/815.45 |
| 7,812,553 | B2 | 10/2010 | Kang et al. | |
| 7,847,783 | B2 * | 12/2010 | Liu et al. | 345/102 |
| 2010/0013395 | A1 * | 1/2010 | Archibald et al. | 315/185 R |
| 2010/0148691 | A1 | 6/2010 | Kuo | |
| 2010/0164403 | A1 * | 7/2010 | Liu | 315/297 |
| 2010/0219766 | A1 * | 9/2010 | Kuo et al. | 315/224 |
| 2011/0050110 | A1 * | 3/2011 | Han | 315/185 R |
| 2011/0062882 | A1 * | 3/2011 | Kuo et al. | 315/287 |

FOREIGN PATENT DOCUMENTS

| | | | |
|---|---|---|---|
| CN | 1925714 | A | 3/2007 |
| CN | 2924579 | Y | 7/2007 |
| CN | 101155450 | A | 4/2008 |
| CN | 101754530 | A | 6/2010 |
| GB | 2429855 | A | 3/2007 |

* cited by examiner

*Primary Examiner* — Haiss Philogene

(57) ABSTRACT

A driving circuit for controlling a light source includes a frequency controller and a switch module. The frequency controller is operable for receiving a first dimming signal for controlling the light source to achieve a predetermined brightness, and for generating a second dimming signal having a frequency out of one or more predetermined ranges according to the first dimming signal when the frequency of the first dimming signal is within the predetermined ranges. The switch module coupled to the frequency controller is operable for switching on and off alternately to achieve the predetermined brightness of the light source according to the second dimming signal when the frequency of the first dimming signal is within the predetermined ranges and according to the first dimming signal when the frequency of the first dimming signal is out of the predetermined ranges.

20 Claims, 8 Drawing Sheets

CIRCUITS AND METHODS FOR CONTROLLING A LIGHT SOURCE

RELATED APPLICATION

This application claims priority to Patent Application No. 201010225108.2, titled "Driving Circuits, Methods and Controllers for Driving a Light Source," filed on Jul. 2, 2010, with the State Intellectual Property Office of the People's Republic of China.

BACKGROUND

Currently, light sources such as light emitting diodes (LEDs) or cold cathode fluorescent lamps (CCFLs) are widely used in the lighting industry, e.g., for backlighting liquid crystal displays (LCDs), street lighting, and home appliances. A light driving circuit can be used to adjust power delivered to the light source according to a dimming signal, e.g., a pulse width modulation (PWM) signal.

FIG. 1 shows a block diagram of a conventional light driving circuit 100. The light driving circuit 100 includes an alternating current (AC) to direct current (DC) converter 104, a power converter 106, and a dimming module 112. The AC to DC converter 104 converts an input AC voltage provided by an AC power source 102 to a first DC voltage. The power converter 106 transforms the first DC voltage to a second DC voltage having a voltage level suitable for powering an LED string 108. The dimming module 112 can operate in a burst-dimming control mode, in which the dimming module 112 generates a pulse width modulation (PWM) signal 120 to adjust the power delivered to the LED string 108 so as to regulate the brightness of the LED string 108. More specifically, the light driving circuit 100 further includes a switch 110 coupled to the LED string 108 and operable for controlling a current $I_{LIGHT}$ flowing through the LED string 108 according to the PWM signal 120, which further determines the brightness of the LED string 108.

FIG. 2 shows a timing diagram 200 of signals generated by the light driving circuit 100. FIG. 2 is described in combination with FIG. 1. In the example of FIG. 2, the timing diagram 200 shows the PWM signal 120 and the current $I_{LIGHT}$ flowing through the LED string 108. When the PWM signal 120 is high, e.g., during a time duration $T_{ON}$ from t1 to t2, the switch 110 is turned on. The current $I_{LIGHT}$ having a predetermined level I1 flows through the LED string 108. When the PWM signal 120 is low, e.g., during a time duration $T_{OFF}$ from t2 to t3, the switch 110 is turned off. The current $I_{LIGHT}$ drops to substantially zero ampere. Thus, by adjusting the duty cycle of the PWM signal 120, an average level of the current $I_{LIGHT}$ is varied to regulate the brightness of the LED string 108.

However, due to the characteristics of semiconductor devices such as the power converter 106, the current $I_{LIGHT}$ needs a delay time $T_{DELAY}$ to reach the predetermined level I1 after the switch 110 is turned on, e.g., at t1 or t3. As such, the dimming control of the LED string 108 may be affected by frequency noise of the light driving circuit 100. For example, if the frequency of the PWM signal 120 is greater than a predetermined threshold $F_{MAX}$ when the duty cycle is relatively low (e.g., the duty cycle is in a range of 0~5%), the time duration $T_{ON}$ is close to or less than the delay time $T_{DELAY}$. Thus, the average level of the current $I_{LIGHT}$ does not vary in accordance with the duty cycle of the PWM signal 120, which results in a failure in dimming control of the light driving circuit 100.

SUMMARY

In one embodiment, a driving circuit for controlling a light source includes a frequency controller and a switch module. The frequency controller is operable for receiving a first dimming signal for controlling the light source to achieve a predetermined brightness, and for generating a second dimming signal having a frequency out of one or more predetermined ranges according to the first dimming signal when the frequency of the first dimming signal is within the predetermined ranges. The switch module coupled to the frequency controller is operable for switching on and off alternately to achieve the predetermined brightness of the light source according to the second dimming signal when the frequency of the first dimming signal is within the predetermined ranges and according to the first dimming signal when the frequency of the first dimming signal is out of the predetermined ranges.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Embodiments in accordance with the present disclosure provide a driving circuit for controlling a light source, e.g., a light emitting diode (LED) string. The driving circuit includes a frequency controller and a switch module. The frequency controller receives a first dimming signal, e.g., a pulse width modulation signal, for controlling the light source to achieve a predetermined brightness. Advantageously, when the frequency of the first dimming signal is within one or more predetermined ranges, the frequency controller can generate a second dimming signal having a frequency outside the predetermined ranges according to the first dimming signal. For example, a predetermined range can be greater than a maximum frequency threshold. In addition, duty cycles of the first dimming signal and the second dimming signal are the same.

Therefore, the switch module can switch on and off alternately to achieve the predetermined brightness of the light source according to the second dimming signal when the frequency of the first dimming signal is within the predetermined ranges and according to the first dimming signal when the frequency of the first dimming signal is outside the predetermined ranges. Thus, the dimming control of the light source will not be affected by the frequency noise, which improves the accuracy of the driving circuit.

Figure 1:
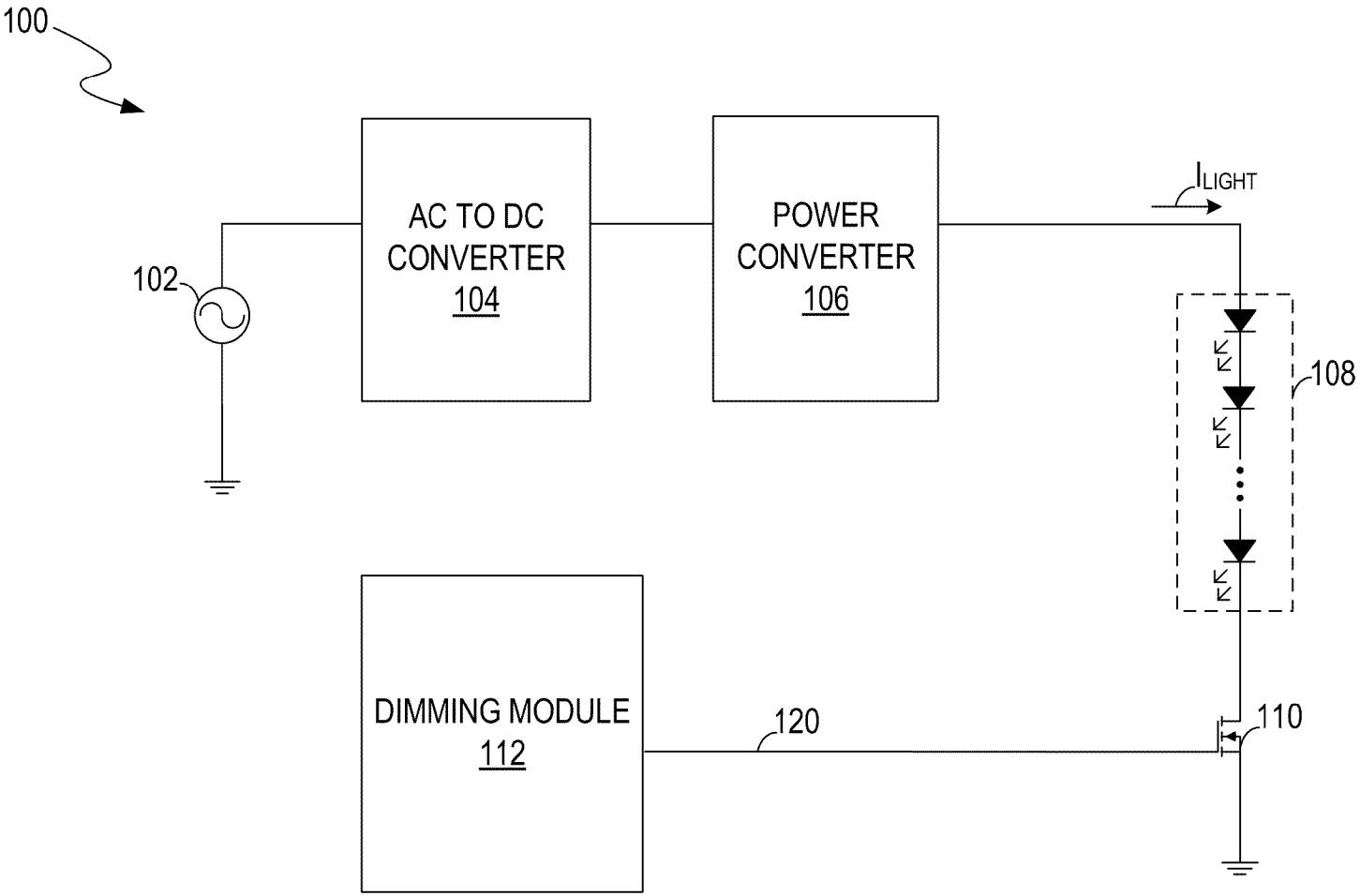
FIG. 1 (PRIOR ART)
FIG. 1 shows a block diagram of a conventional light driving circuit.
Figure 2:
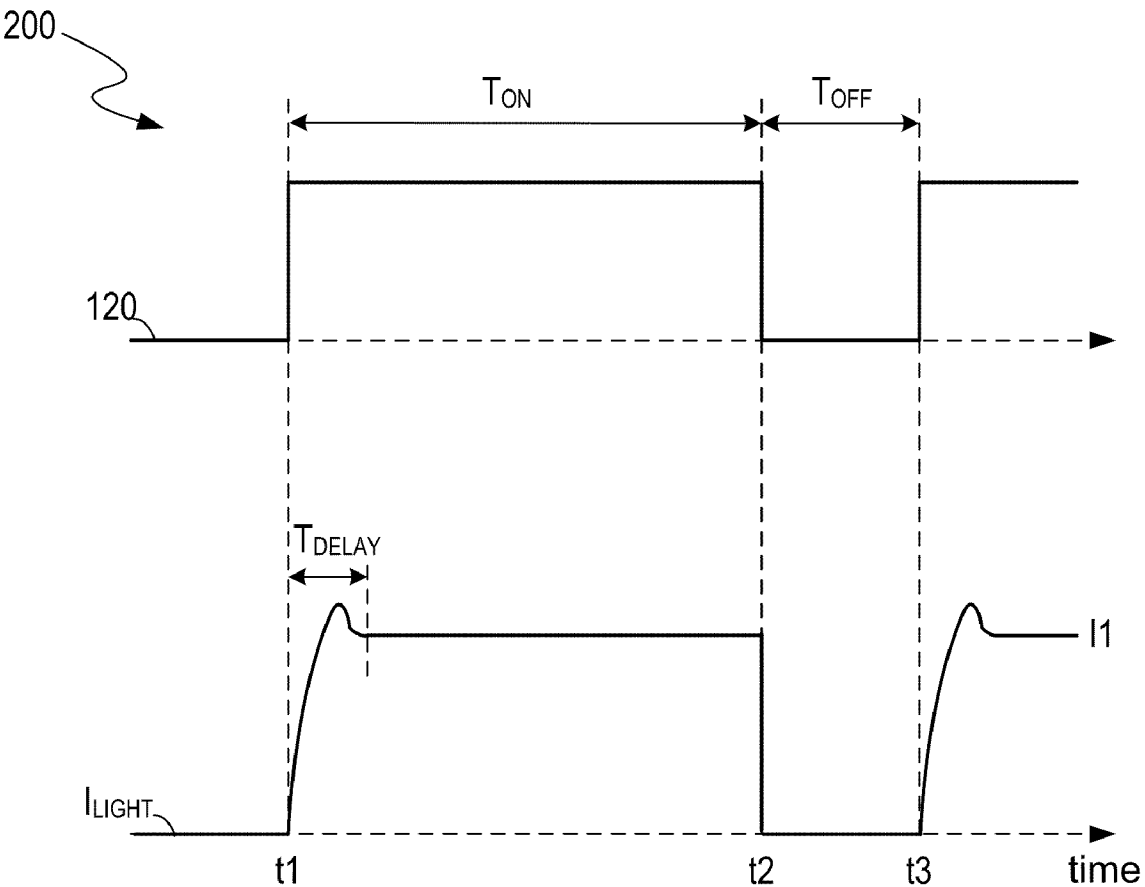
FIG. 2 (PRIOR ART)
FIG. 2 shows a timing diagram of signals generated by the light driving circuit in FIG. 1.
Figure 3:
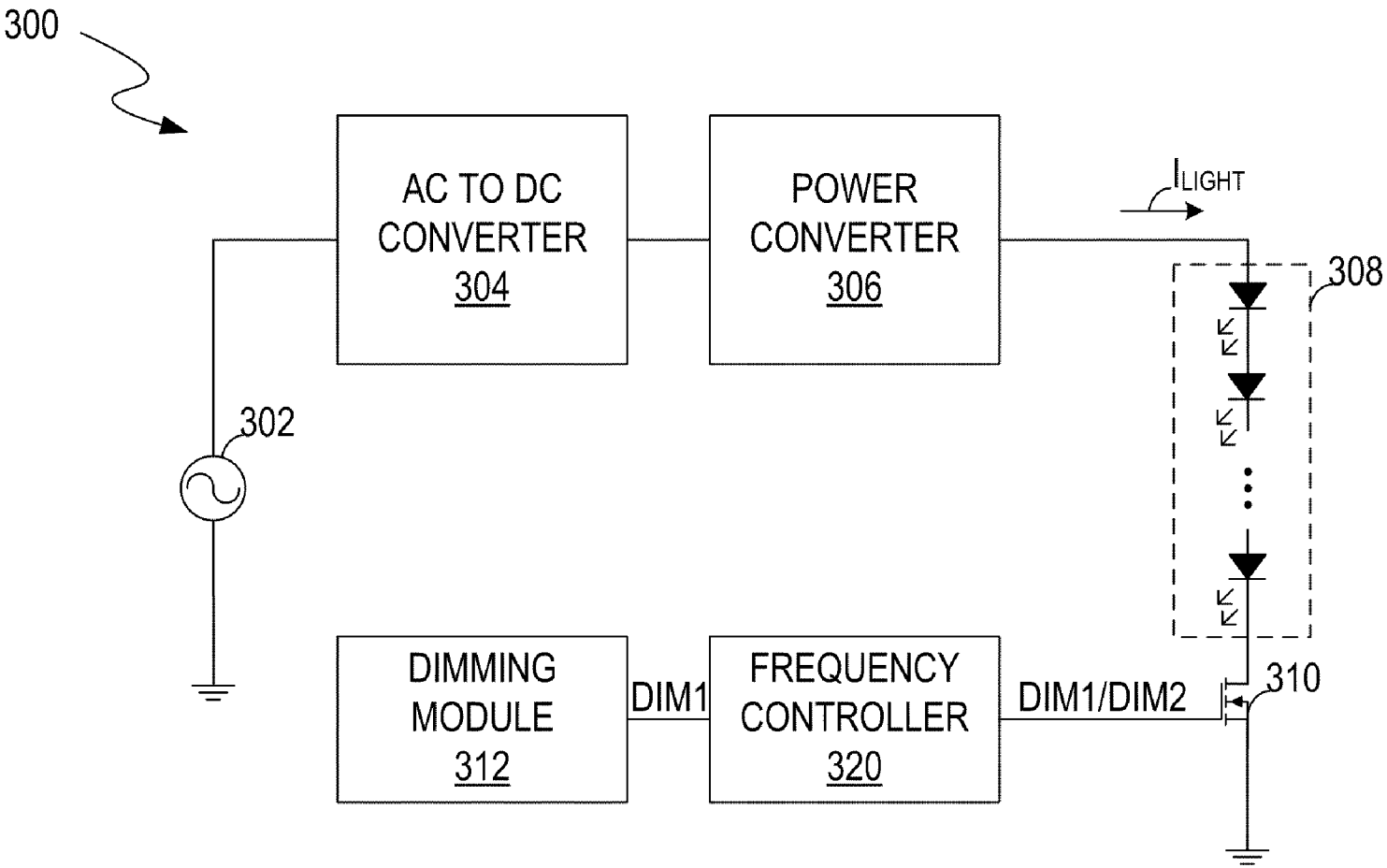
FIG. 3 illustrates a block diagram of a driving circuit for controlling a light source, in accordance with one embodiment of the present invention.

FIG. 3 illustrates a block diagram of a driving circuit 300 for controlling a light source, in accordance with one embodiment of the present invention. In one embodiment, the driving circuit 300 includes an alternating current (AC) power source 302, an AC to direct current (DC) converter 304, a power converter 306, a light source 308, a switch module 310, a dimming module 312, and a frequency controller 320. The light source 308 can include one or more light source strings such as a light emitting diode (LED) string having multiple series-connected LEDs. Although one light source string is shown in the example of FIG. 1, other number of light source strings can be included in the light source 308. The AC power source 302 provides an input AC voltage, e.g., a 120 volt commercial voltage supply. The AC to DC converter 304 coupled to the AC power source 302 converts the input AC voltage to a first DC voltage. The power converter 306 transforms the first DC voltage into a second DC voltage having a voltage level suitable for powering the light source 308. The operations of the AC to DC converter 304 and the power converter 306 are further described in relation to FIG. 4.

In one embodiment, the switch module 310 includes a switch coupled to the LED string 308, and is operable for controlling power delivered to the LED string 308 according to a dimming signal, such that the LED string 308 can achieve a predetermined brightness. More specifically, in one embodiment, the dimming signal can be a pulse signal such as a pulse width modulation (PWM) signal. When the dimming signal has a logic high level, the switch 310 is turned on. Thus, a current $I_{LIGHT}$ flows through the LED string 308, and the LED string 308 is lit up to emit light, which is referred to as an ON state of the LED string 308. When the dimming signal has a logic low level, the switch 310 is turned off. Thus, the current $I_{LIGHT}$ drops to substantially zero ampere, and the LED string 308 is cut off, which is referred to as an OFF state of the LED string 308. When a switching frequency of the switch 310 is greater than a predetermined minimum threshold $F_{MIN}$, the flicker of the LED string 308 (e.g., caused by the switching between ON and OFF states of the LED string 308) is imperceptible, e.g., by human eyes. In this circumstance, an average level of the current $I_{LIGHT}$ can be adjusted by adjusting the duty cycle of the dimming signal, which can further determine the brightness of the LED string 308.

In one embodiment, the dimming module 312 can be a signal generator operable for generating a dimming signal DIM1, e.g., a PWM signal, to control the power delivered to the LED string 308 to achieve the predetermined brightness. For example, a user can set the duty cycle of DIM1 to set the predetermined brightness.

The frequency controller 320 coupled between the dimming module 312 and the switch 310 receives the dimming signal DIM1 and determines whether the frequency $F_{DIM1}$ of the dimming signal DIM1 is within one or more predetermined ranges. By way of example, a predetermined range can be greater than a predetermined maximum threshold $F_{MAX}$. In some circumstances, the accuracy of the dimming control may be affected by the frequency noise if the frequency $F_{DIM1}$ of the dimming signal DIM1 is within the predetermined range, e.g., greater than $F_{MAX}$. The present disclosure is described in relation to the predetermined range of greater than $F_{MAX}$ for illustrative purposes; however, this invention is not so limited, the one or more predetermined ranges can include other ranges such as a range of less than F1 and/or a range of greater than F2 but less than F3, where F1<F2<F3, in an alternative embodiment.

In one embodiment, if the frequency of the dimming signal DIM1 is within a predetermined range, e.g., greater than $F_{MAX}$, the frequency controller 320 generates a dimming signal DIM2, e.g., a second PWM signal, according to the dimming signal DIM1. The frequency $F_{DIM2}$ of the dimming signal DIM2 is different from the frequency $F_{DIM1}$ of the dimming signal DIM1. For example, $F_{DIM2}$ is less than the maximum threshold $F_{MAX}$ such that $F_{DIM2}$ is outside the predetermined range. Moreover, the frequency controller 320 maintains duty cycles of the dimming signal DIM1 and the dimming signal DIM2 to be the same. As such, the predetermined brightness of the LED string 308 can be achieved by controlling the power delivered to the LED string 308 according to the dimming signal DIM2. In this condition, the frequency controller 320 transfers the dimming signal DIM2 to the switch 310. The switch 310 controls the power delivered to the LED string 308, e.g., by controlling the current $I_{LIGHT}$, according to the dimming signal DIM2.

If the frequency of the dimming signal DIM1 is outside the predetermined range, e.g., less than $F_{MAX}$, the frequency controller 320 transfers the dimming signal DIM1 to the switch 310. In this condition, the switch 310 controls the power delivered to the LED string 308, e.g., by controlling the current $I_{LIGHT}$, according to the dimming signal DIM1.

Therefore, based upon the frequency $F_{DIM1}$ of the dimming signal DIM1, the switch 310 controls the power delivered to the LED string 308 according to a dimming signal selected from at least the first dimming signal DIM1 and the second dimming signal DIM2. As a result, the frequency of the dimming signal that is used to control the LED string 308 remains below the maximum threshold $F_{MAX}$. As such, the current $I_{LIGHT}$ flowing through the LED string 308 is not be affected by the frequency noise. For example, although the current $I_{LIGHT}$ may need a delay time $T_{DELAY}$ to reach a predetermined level I1 after the switch 310 is turned on and although the duty cycle of the dimming signal may have a relatively small value, e.g., 0-5%, the time duration $T_{ON}$ of the ON state of the LED string 308 can be enforced to be greater than the delay time $T_{DELAY}$. Thus, the accuracy of the driving circuit 300 is improved.

Figure 4:
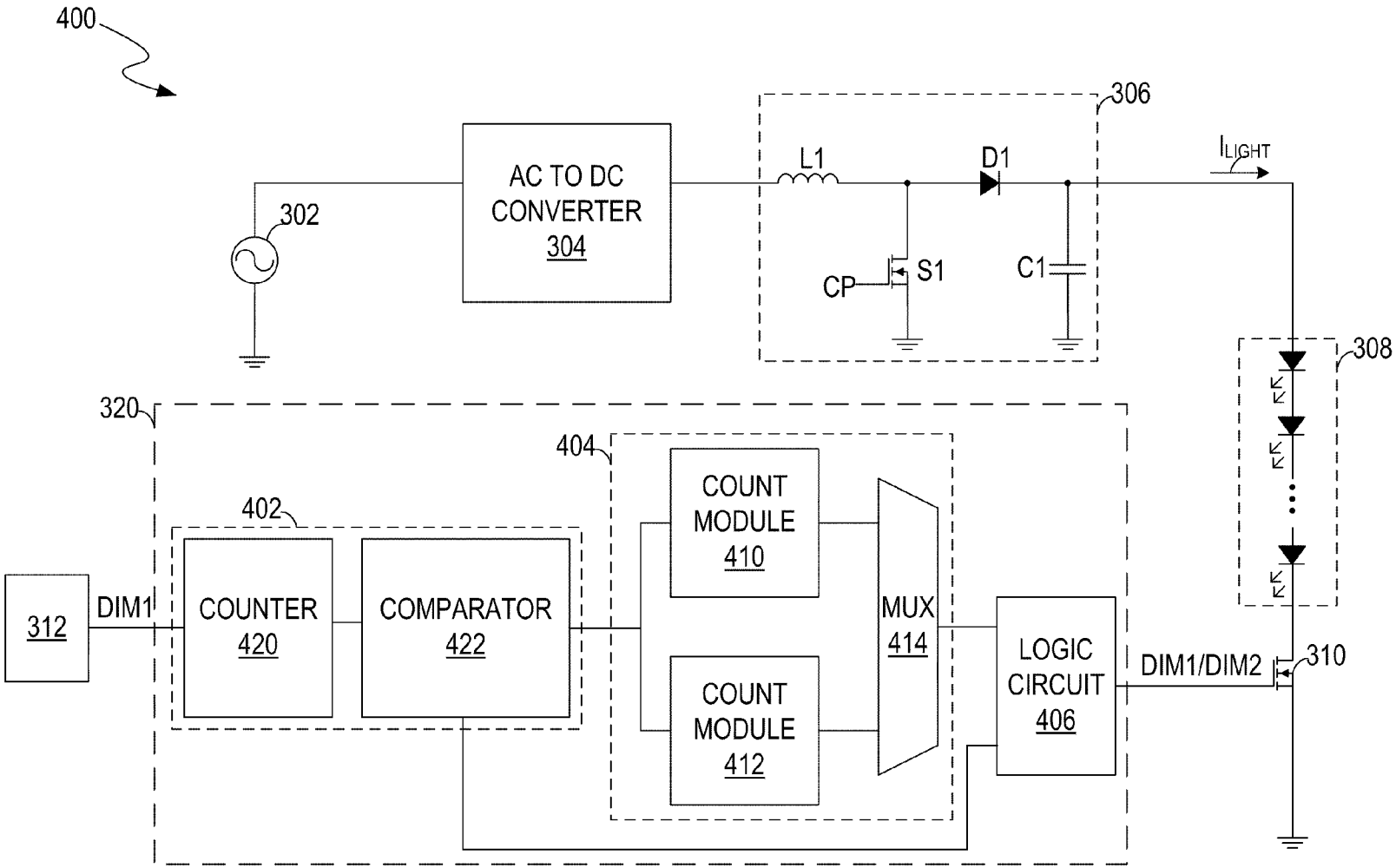
FIG. 4 illustrates a diagram of a driving circuit for controlling a light source, in accordance with one embodiment of the present invention.

FIG. 4 illustrates a diagram of a driving circuit 400 for controlling a light source, e.g., the LED string 308, in accordance with one embodiment of the present invention. Elements labeled the same as in FIG. 3 have similar functions. FIG. 4 is described in combination with FIG. 3.

In one embodiment, the AC to DC converter 304 includes a rectifier circuit and a filter. The rectifier circuit can include, but is not limited to, a half-wave rectifier, a full-wave rectifier, or a bridge rectifier. The rectifier circuit commutates the input AC voltage to provide a first DC voltage. For example, the rectifier circuit can exclude negative waves of the input AC voltage, or converts the negative waves to corresponding positive waves. Therefore, the first DC voltage having positive voltage waves is obtained at the output of the rectifier circuit. The filter can be a low pass filter operable for filtering the first DC voltage, such that ripples of the first DC voltage can be reduced or eliminated. Alternatively, the AC power source 302 and the AC to DC converter 304 can be substituted by a DC power source. For example, the first DC voltage can be provided by a battery pack coupled to the power converter 306.

The power converter 306 converts the first DC voltage to a second DC voltage suitable for powering the LED string 308. In the example of FIG. 4, the power converter 306 can be a boost converter including an inductor L1, a diode D1, a capacitor C1, and a switch S1. By adjusting an on time and an off time of the switch S1, e.g., according to a PWM signal CP, the power converter 306 can adjust energy stored in the inductor L1 and the capacitor C1. In this way, the power converter 306 generates a second DC voltage greater than the first DC voltage, in one embodiment. The second DC voltage is capable of forward biasing the LED string 308, e.g., when the switch 310 is turned on. The power converter 306 can have other configurations, e.g., the power converter 306 can include a buck converter, a buck-boost converter, or a flyback converter, and is not limited to the example of FIG. 4.

The dimming module 312 generates the dimming signal DIM1. For example, the dimming signal DIM1 can be a pulse signal such as a PWM signal, and the duty cycle of the dimming signal DIM1 represents the predetermined brightness of the LED string 308. The duty cycle can be set by users. The dimming signal DIM1 is received by the frequency controller 320. In one embodiment, the frequency controller 320 includes a frequency detector 402, a frequency converter 404, and a logic circuit 406.

The frequency detector 402 can detect the frequency of the dimming signal DIM1 to determine whether the frequency of the dimming signal DIM1 is within a predetermined range, e.g., the range is $F_{MAX}$ to the positive infinity (+∞). In one embodiment, the frequency detector 402 includes a counter 420 operable for measuring the frequency of the dimming signal DIM1. More specifically, the dimming signal DIM1 can be clocked by (synchronized with) a predetermined sample clock signal. The predetermined sample clock signal can be a periodical square-wave signal having a fixed cycle period $T_{CLOCK}$, in one embodiment. In operation, the counter 420 can count the number M of the cycles of the sample clock signal clocked during a cycle period of the dimming signal DIM1. The frequency $F_{DIM1}$ of the dimming signal DIM1 is obtained according to the number M and the cycle period $T_{CLOCK}$ of the sample clock signal, which can be given by:

$$F_{DIM1}=1/(M*T_{CLOCK}). \quad (1)$$

Furthermore, the frequency detector 402 can include a comparator 422 operable for comparing the detected frequency $F_{DIM1}$ to one or more predetermined thresholds so as to determine whether the frequency $F_{DIM1}$ is within the predetermined range. In one embodiment, the comparator 422 compares the frequency $F_{DIM1}$ to the predetermined maximum threshold $F_{MAX}$. If the frequency $F_{DIM1}$ is greater than $F_{MAX}$, it indicates that the frequency $F_{DIM1}$ is within the predetermined range. Thus, the comparator 422 transfers the dimming signal DIM1 to the frequency converter 404. If the frequency $F_{DIM1}$ is less than $F_{MAX}$, it indicates that the frequency $F_{DIM1}$ is outside the predetermined range. Thus, the comparator 422 transfers the dimming signal DIM1 to the logic circuit 406. The logic circuit 406 further transfers the dimming signal DIM1 to the switch 310. The switch 310 can adjust the current $I_{LIGHT}$ through the LED string 308 accordingly. The frequency detector 402 can include other components and is not limited to the configuration in the example of FIG. 4.

The frequency converter 404 is operable for generating the dimming signal DIM2 according to the dimming signal DIM1. In one embodiment, the frequency converter 404 varies the frequency $F_{DIM1}$ and maintains the duty cycle $D_{DIM1}$ to generate the dimming signal DIM2. The dimming signal DIM2 has a frequency $F_{DIM2}$ and a duty cycle $D_{DIM2}$. The frequency $F_{DIM2}$ is less than $F_{MAX}$ and outside the predetermined range. The duty cycle $D_{DIM2}$ is the same as the duty cycle $D_{DIM1}$ of the dimming signal DIM1. As such, the predetermined brightness indicated by the dimming signal DIM1 is also indicated by the dimming signal DIM2.

More specifically, the frequency converter 404 can employ a first sample clock signal and a second sample clock signal to generate the dimming signal DIM2 whose frequency is a fraction of that of the dimming signal DIM1. In one embodiment, both the first sample clock signal and the second sample clock signal can be periodical square-wave signals with fixed frequencies. A frequency of the second sample clock signal, e.g., $F_{CLOCK2}$, is a fraction of a frequency of the first sample clock signal e.g., $F_{CLOCK1}$, which can be given by:

$$F_{CLOCK2}=(1/N)*F_{CLOCK1}. \quad (2)$$

The frequency converter 404 counts the first sample clock signal to obtain result data indicating the cycle period and the duty cycle of DIM1, and then uses the result data and the second sample clock signal to generate the dimming signal DIM2.

In the example of FIG. 4, the frequency converter 404 includes a multiplexer 414, and one or more count modules such as a count module 410 and a count module 412. In one embodiment, when one count module is used to detect the duty cycle and cycle period of the dimming signal DIM1, the other count module is used to determine the duty cycle and cycle period of the dimming signal DIM2. In one embodiment, each of the count modules 410 and 412 includes a period counter and a duty counter. When a corresponding count module, e.g., the count modules 410, is working to detect the dimming signal DIM1, the period counter in the count modules 410 can count the number N1A of the cycles of the first sample clock signal clocked during a cycle period of the dimming signal DIM1. In this way, the period counter obtains period data indicative of the cycle period of the dimming signal DIM1. Moreover, the duty counter can count the number N1B of the cycles of the first sample clock signal clocked during a time period $T_{STATE1}$ when the dimming signal DIM1 has a predetermined state (e.g., a logic high level or a logic low level) in one cycle period of the dimming signal DIM1. In this way, the duty counter obtains duty data indicative of the duty cycle of the dimming signal DIM1. For example, when the time period $T_{STATE1}$ represents the logic high level of the dimming signal DIM1, the duty data indicative of the duty cycle $D_{DIM1}$ of DIM1 can be obtained according to a combination of N1A and N1B, e.g., $D_{DIM1}$=N1B/N1A. When the time period $T_{STATE1}$ represents the logic low level of the dimming signal DIM1, the duty data indicative of the duty cycle $D_{DIM1}$ of DIM1 can be obtained according to a combination of N1A and N1B, e.g., $D_{DIM1}$=1−(N1B/N1A). As such, the result data including the period data and the duty data is obtained. The operation of the count module for detecting the dimming signal DIM1 is further described in relation to FIG. 5.

When a corresponding count module, e.g., the count module 412, is working to generate the dimming signal DIM2, the period counter in the count modules 412 can determine the cycle period $T_{DIM2}$ of the dimming signal DIM2 by counting the number of the cycles of the second sample clock signal according to the period data, e.g., the number N1A. For example, $T_{DIM2}$ is equal to N1A times the cycle period of the second sample clock signal. Moreover, the duty counter in the count modules 412 can determine the duty cycle of the dimming signal DIM2 by counting the number of the cycles of the second sample clock signal according to the duty data. For example, the time duration $T_{STATE2}$ of a corresponding predetermined state (e.g., a logic high level or a logic low level) of DIM2 is equal to N1B times the cycle period of the second sample clock signal. The duty cycle of the dimming signal DIM2 is given by, e.g., $D_{DIM2}=T_{STATE2}/T_{DIM2}$ (when the time period $T_{STATE2}$ represents the logic high level of the dimming signal DIM2) or $D_{DIM2}=1-(T_{STATE2}/T_{DIM2})$ (when the time period $T_{STATE2}$ represents the logic low level of the dimming signal DIM2). The operation of the count module for generating the dimming signal DIM2 is further described in relation to FIG. 5.

As a result, both $T_{DIM1}$ and $T_{STATE1}$ of the dimming signal DIM1 are multiplied by the same number N to obtain $T_{DIM2}$ and $T_{STATE2}$ of the dimming signal DIM2, where N is determined according to equation (2). Thus, the frequency $F_{DIM2}$ is a fraction of the frequency $F_{DIM1}$, which can be given by:

$$F_{DIM2}=(1/N)*F_{DIM1}. \tag{3}$$

As shown in equation (3), the fraction 1/N is also determined by a ratio of the frequency of the second sample clock signal to the frequency of the first sample clock signal obtained from equation (2). In addition, the duty cycle $D_{DIM2}$ can be the same as the duty cycle $D_{DIM1}$ according to equation (4).

$$\begin{aligned} D_{DIM2}&=T_{STATE2}/T_{DIM2}=(N*T_{STATE1})/(N*T_{DIM1})\\ &=T_{STATE1}/T_{DIM1}=D_{DIM1}. \end{aligned} \tag{4}$$

Figure 5:
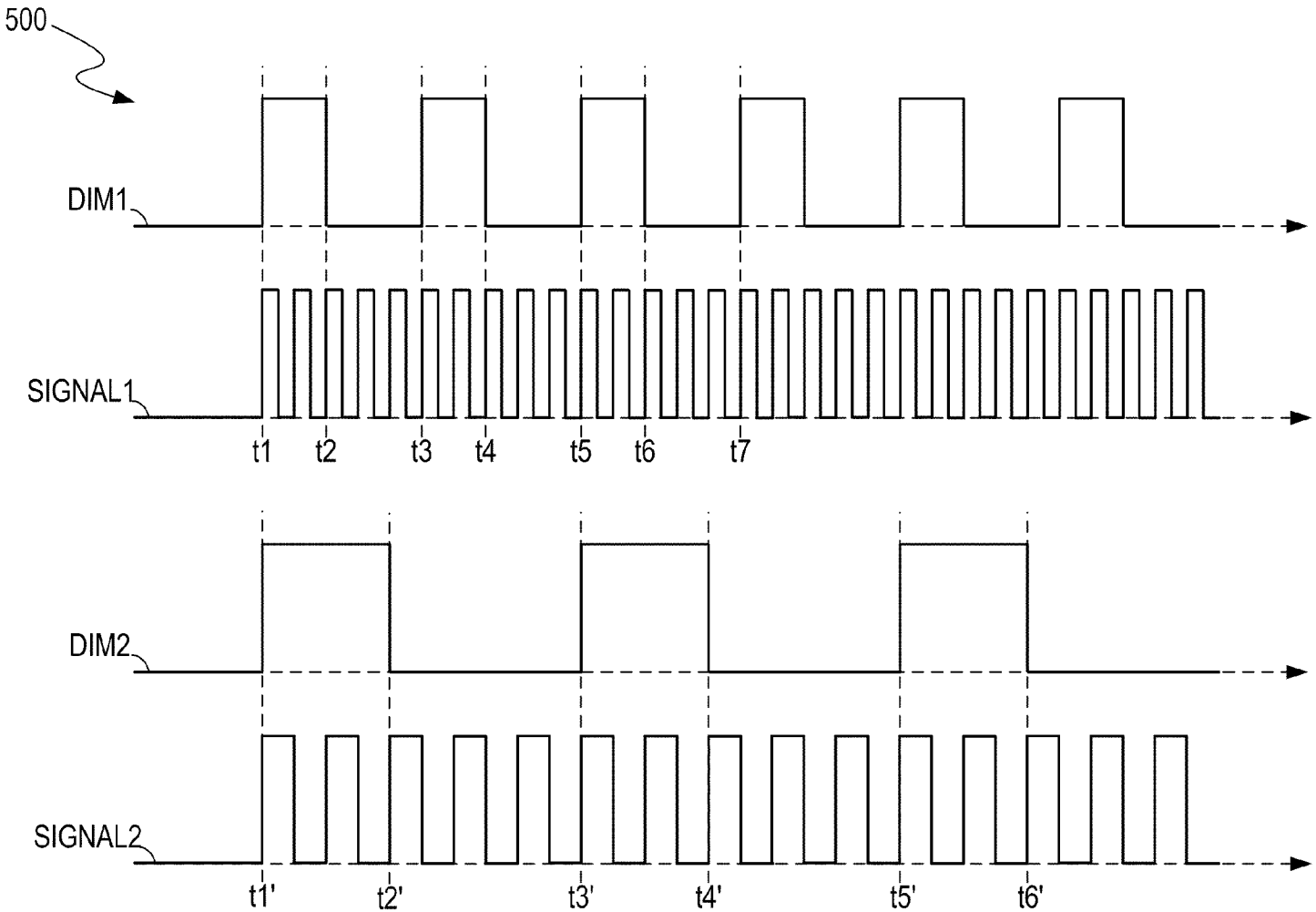
FIG. 5 illustrates an example of a timing diagram of signals received and generated by a frequency converter, in accordance with one embodiment of the present invention.

FIG. 5 illustrates an example of a timing diagram 500 of signals received and generated by the frequency converter 404 in FIG. 4, in accordance with one embodiment of the present invention. In the example of FIG. 5, the timing diagram 500 shows the dimming signal DIM1, the first sample clock signal SIGNAL1, the dimming signal DIM2, and the second sample clock signal SIGNAL2. In addition, the frequency $F_{CLOCK2}$ of SIGNAL2 is a fraction 1/N of the frequency $F_{CLOCK1}$ of SIGNAL1. For example, in FIG. 5, $F_{CLOCK2}$ is ½ of $F_{CLOCK1}$.

During the time interval from t1 to t7, one or more corresponding count modules perform counting operation to obtain the result data. At time t1, the corresponding count module counts the number of cycles of the first sample clock signal SIGNAL1. As shown in the example of FIG. 5, 5 cycles of the first sample clock signal SIGNAL1 is clocked during a cycle period of the dimming signal DIM1, e.g., from t1 to t3 or from t3 to t5. As such, the period counter obtains the period data 5. Furthermore, 2 cycles of the first sample clock signal SIGNAL1 is clocked during a time duration when the dimming signal DIM1 has a logic high level in one cycle period of the dimming signal DIM1, e.g., from t1 to t2, from t3 to t4, or from t5 to t6. Accordingly, the duty data indicative of the duty cycle of the dimming signal DIM1 is 40%.

During the time interval from t1' to t6', one or more count modules use the result data (including the period data and the duty data) and the second sample clock signal SIGNAL2 to generate the dimming signal DIM2. As shown in the example of FIG. 5, the cycle period of the dimming signal DIM2 is equal to 5 times the cycle period of the second sample clock signal SIGNAL2, e.g., from t1' to t3' or from t3' to t5'. Moreover, a time duration of the logic high level of the dimming signal DIM2 is equal to 2 times the cycle period of the second sample clock signal SIGNAL2, e.g., from t1' to t2', from t3' to t4', or from t5' to t6'. As such, the duty cycle of the dimming signal DIM2 is also 40%.

As such, to generate the dimming signal DIM2, both the cycle period of the dimming signal DIM1 and the time duration of the high electrical level of DIM1 are multiplied by the same predetermined number N (e.g., N=2 in FIG. 5). The predetermined number N is determined by the signals SIGNAL1 and SIGNAL2 according to equation (2). As a result, the frequency of the dimming signal DIM2 is a fraction (1/N) of the frequency of the dimming signal DIM1.

In one embodiment, the signals SIGNAL1 and SIGNAL2 can have fixed frequencies that are predetermined or programmed by a user. For example, the user can set the ratio N to a substantially constant value. Alternatively, the signals SIGNAL1 and SIGNAL2 can be generated by a signal generator, in which the ratio N or the fraction 1/N is determined according to the frequency $F_{DIM1}$ of the dimming signal DIM1. In other words, the ratio N can vary in accordance with the frequency $F_{DIM1}$. For example, if the frequency $F_{DIM1}$ of the dimming signal DIM1 is greater than $F_{MAX}$ and is less than F1, e.g., $F_{MAX}<F_{DIM1}<F1$, the ratio N is equal to N1. If the frequency $F_{DIM1}$ of the dimming signal DIM1 is greater than F1, the ratio N is equal to N2, where N2 is greater than N1.

Referring to FIG. 4 and FIG. 5, the count modules 410 and 412 can alternately count the number of cycles of the first sample clock signal SIGNAL1 to obtain the result data and count the number of cycles of the second sample clock signal SIGNAL2 according to the result data to generate the dimming signal DIM2, in one embodiment. By way of example, the count module 410 detects the dimming signal DIM1 by counting the cycles of the first sample clock signal SIGNAL1 from time t1 to t3. At time t3, the count module 410 obtains the period data and the duty data. Then, the count module 410 generates the dimming signal DIM2 by counting the number of cycles of the second sample clock signal SIGNAL2 from time t1' to t3'. In this instance, the time t1' corresponds to the time t3, and the time t3' corresponds to the time t7. Thus, at time t3 or t1', the count module 412 starts to detect the dimming signal DIM1 by counting the number of cycles of the first sample clock signal SIGNAL1. Similarly, the count module 412 obtains the period data and the duty data at time t5. After the count module 410 completes generating the dimming signal DIM2 at time t3' or t7, the count module 410 goes back to detect the dimming signal DIM1, and the count module 412 starts to generate the dimming signal DIM2. In this way, the dimming signal DIM2 can be a continuous PWM signal.

The multiplexer 414 transfers the dimming signal DIM2 generated by the count module 410 or the count module 412 to the logic circuit 406. The logic circuit 406 further transfers the dimming signal DIM2 whose frequency is outside the predetermined range to the switch 310.

Figure 6:
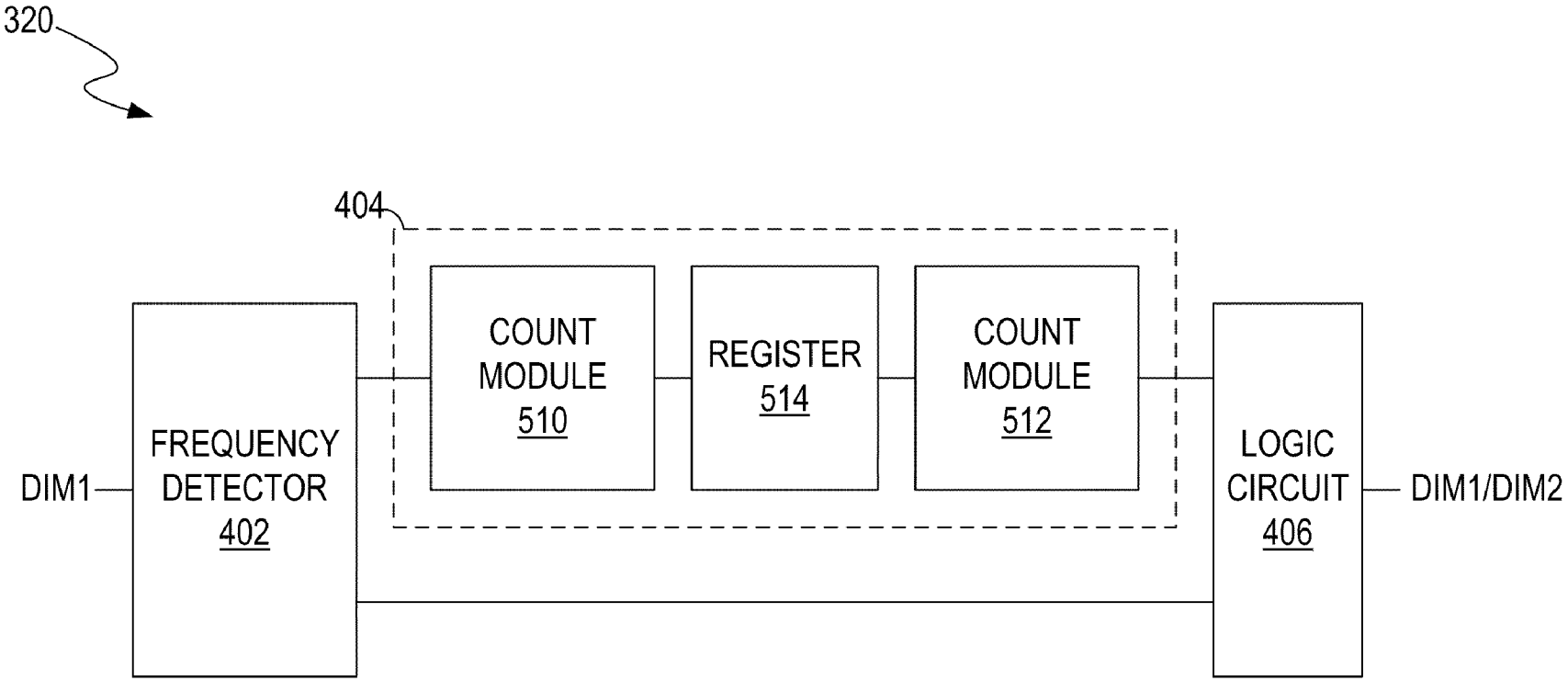
FIG. 6 illustrates an example of a frequency controller, in accordance with one embodiment of the present invention.

FIG. 6 illustrates another example of the frequency controller 320, in accordance with one embodiment of the present invention. Elements labeled the same as in FIG. 4 have similar functions. FIG. 6 is described in combination with FIG. 3-FIG. 5.

In the example of FIG. 6, the frequency converter 404 includes a count module 510, a register 514, and a count module 512. The count module 510 is operable for detecting the dimming signal DIM1 by counting the cycles of the first sample clock signal SIGNAL1, e.g., from time t1 to t7 in FIG. 5, and can store the result data including the period data and the duty data in the register 514 coupled to the count module 510. The count module 512 coupled to the register 514 is operable for reading the result data, and for generating the dimming signal DIM2 by counting the cycles of the second sample clock signal SIGNAL2 accordingly, e.g., from t1' to t6' in FIG. 5. As such, in this instance, the time t1' corresponds to the time t1, and the time t3' corresponds to the time t5.

The frequency controller 320 can have other configurations, and is not limited to the example in FIG. 4 and FIG. 6. In another embodiment, the count module 510 can be removed from the frequency controller 320 and the frequency detector 402 can be designed with the functional features of the count module 510. For example, the frequency detector 402 can detect the frequency and the duty cycle of the dimming signal DIM1 by counting the first sample clock signal SIGNAL1. If the detected frequency of the dimming signal DIM1 is greater than $F_{MAX}$, the frequency detector 402 can store the period data and the duty data in the register 514. The count module 512 uses the second sample clock signal SIGNAL2 and the result data to generate the dimming signal DIM2, which is further forwarded to the logic circuit 406. If the frequency of the dimming signal DIM1 is less than $F_{MAX}$, the frequency detector 402 transfers the dimming signal DIM1 to the logic circuit 406.

Figure 7:
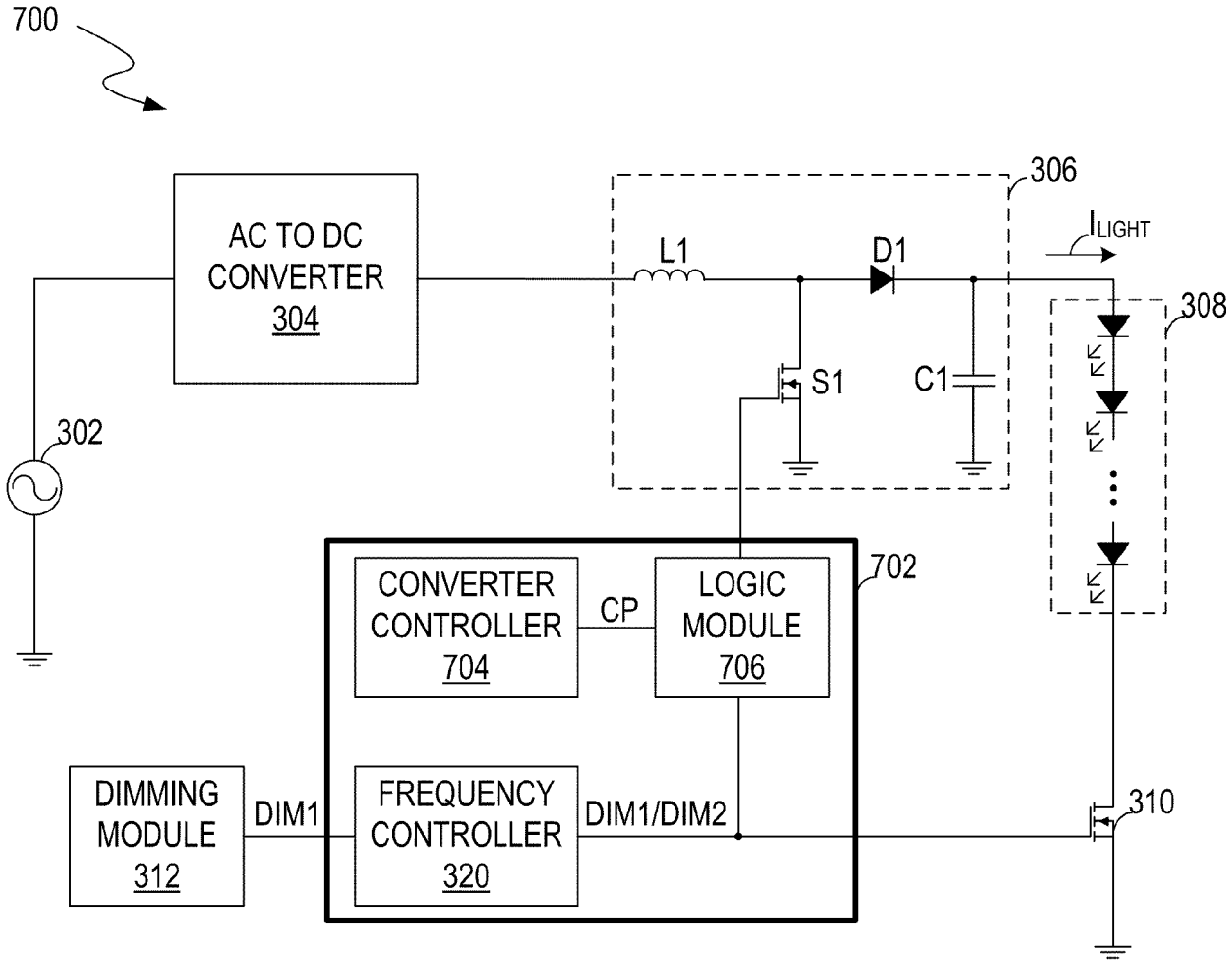
FIG. 7 illustrates another block diagram of a driving circuit for controlling a light source, in accordance with one embodiment of the present invention.

FIG. 7 illustrates another block diagram of a driving circuit 700 for controlling a light source, in accordance with one embodiment of the present invention. Elements labeled the same as in FIG. 3 and FIG. 4 have similar functions. FIG. 7 is described in combination with FIG. 3, FIG. 4 and FIG. 6. In the example of FIG. 7, the driving circuit 700 includes an AC power source 302, an AC to DC converter 304, a power converter 306, a light source 308, a switch module 310, a dimming module 312, and a controller 702. The controller 702 coupled to the switch module 310 and the power converter 306 can be integrated in an integrated circuit (IC) chip and is used to control the dimming of the light source 308 by controlling the switch module 310 and the power converter 306.

In one embodiment, the controller 702 includes a frequency controller 320, a converter controller 704, and a logic module 706. The frequency controller 320 employs similar configurations as disclosed in relation to FIG. 4 and FIG. 6. Thus, the controller 702 is capable of turning on and off the switch module 310 according to a selected dimming signal DIM1/DIM2 to control the current flowing through the light source 308, thereby achieving the predetermined brightness of the light source 308. The selected dimming signal is DIM1 when the frequency $F_{DIM1}$ of DIM1 is outside the predetermined range, e.g., less than $F_{MAX}$, and is DIM2 when the frequency $F_{DIM1}$ is within the predetermined range, e.g., greater than $F_{MAX}$.

The converter controller 704 is operable for generating the PWM signal CP to drive the power converter 306. The logic module 706 coupled to the converter controller 704 and the frequency controller 320 is operable for detecting the selected dimming signal, e.g., DIM1/DIM2, to obtain the switching condition of the switch module 310 and for controlling the power converter 306 accordingly. More specifically, in one embodiment, when the selected dimming signal indicates that the switch module 310 is turned on, the logic module 706 transfers the PWM signal CP to the power converter 306. Then, the power converter 306 adjusts energy stored in the inductor L1 and the capacitor C1 by adjusting an on time and an off time of the switch S1 according to the PWM signal CP, as mentioned in relation to FIG. 4. Thus, the first DC voltage is converted to the second DC voltage to forward bias the LED string 308.

When the selected dimming signal indicates the switch module 310 is turned off, the current $I_{LIGHT}$ drops to the substantially zero ampere. Then, the logic module 706 transfers a termination signal (e.g., a logic one signal instead of the PWM signal CP) to the switch S1, in order to terminate the operation of the power converter 306. For example, the switch S1 maintains on according to the logic one signal, such that the energy stored in the inductor L1 and the capacitor C1 is dissipated. In this way, the power converter 306 stops converting the first DC voltage to the second DC voltage. Moreover, the power converter 306 no longer consumes energy from the AC power source 302, which reduces the power consumption of the driving circuit 700.

In conclusion, the power converter 306 operates to provide the second DC voltage to drive the light source 308 when the switch module 310 is turned on, and stops operating when the switch module 310 is turned off. As such, the power efficiency of the driving circuit 700 is improved.

Figure 8:
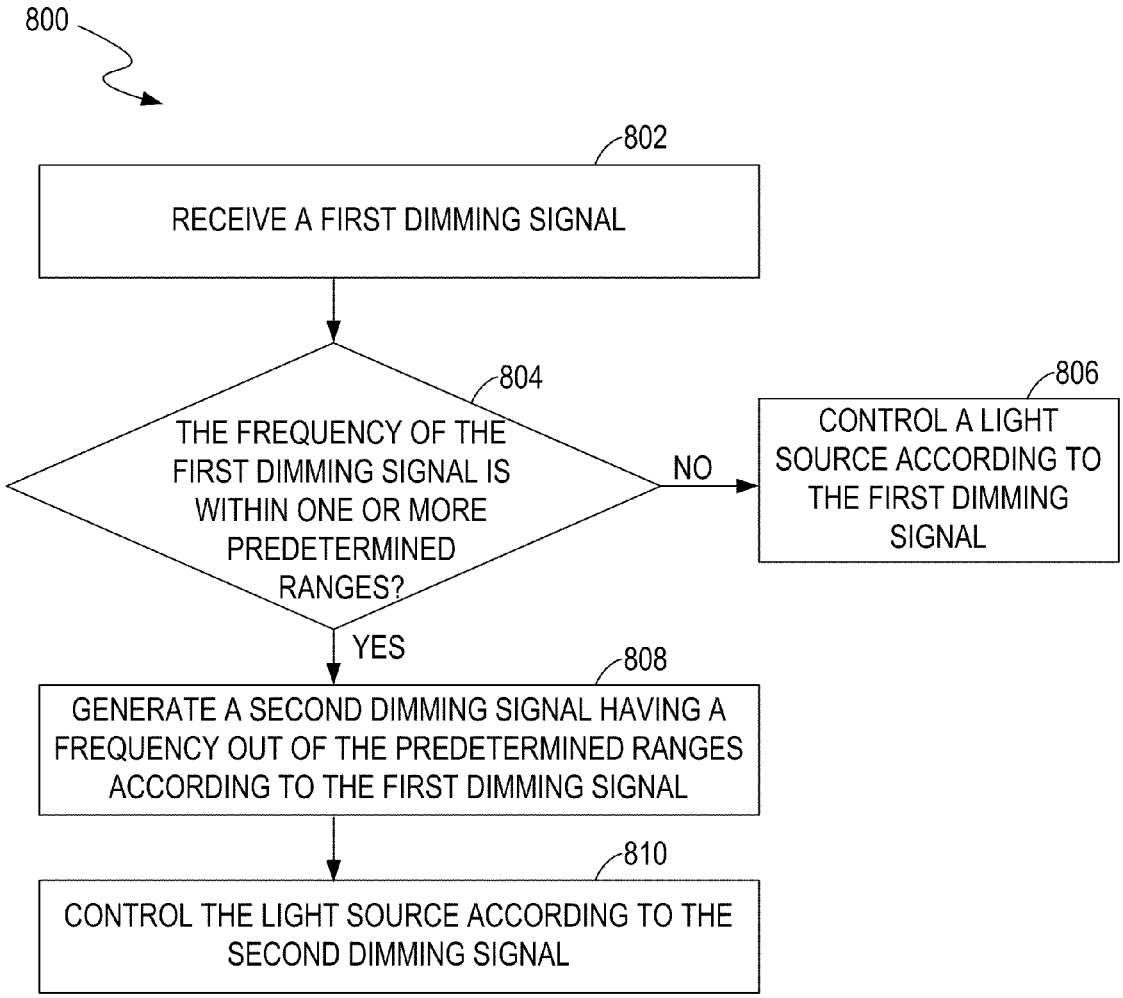
FIG. 8 illustrates a flowchart of operations performed by a driving circuit, in accordance with one embodiment of the present invention.

FIG. 8 illustrates a flowchart 800 of operations performed by a driving circuit, e.g., the driving circuit 300, 400 or 700, in accordance with one embodiment of the present invention. FIG. 8 is described in combination with FIG. 3-FIG. 7. Although specific steps are disclosed in FIG. 8, such steps are examples. That is, the present invention is well suited to performing various other steps or variations of the steps recited in FIG. 8.

In block 802, a first dimming signal, e.g., the dimming signal DIM1, for controlling a light source to achieve a predetermined brightness is received.

In block 804, the first dimming signal is detected to determine whether the frequency of the first dimming signal, e.g., the frequency $F_{DIM1}$, is within one or more predetermined ranges, e.g., greater than $F_{MAX}$. If the frequency of the first dimming signal is out of the predetermined ranges, the flowchart 800 goes to block 806. In block 806, the light source is controlled to achieve the predetermined brightness according to the first dimming signal. If the frequency of the first dimming signal is within the predetermined ranges, the flowchart 800 goes to block 808.

In block 808, a second dimming signal, e.g., the dimming signal DIM2, having a frequency out of the predetermined ranges is generated according to the first dimming signal. In one embodiment, both the first dimming signal and the second dimming signal include PWM signals. Duty cycles of the first dimming signal and the second dimming signal are maintained to be the same. In one embodiment, to generate the second dimming signal, both a cycle period of the first dimming signal and a TON period of the first dimming signal are multiplied by the same number. In one embodiment, the number is adjustable according to the frequency of the first dimming signal. In one embodiment, the number of cycles of a first sample clock signal, e.g., the first sample clock signal SIGNAL1, is counted to obtain the result data indicative of the cycle period and the duty cycle of the first dimming signal. The number of cycles of a second sample clock signal, e.g., the second sample clock signal SIGNAL2, is counted according to the result data to generate the second dimming signal. The frequency of the first dimming signal is a fraction of the frequency of the second dimming signal. The fraction is determined by a ratio of the frequency of the first sample clock signal to the frequency of the second sample clock signal.

In block 810, the light source is controlled to achieve the predetermined brightness according to the second dimming signal.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A circuit for driving a light emitting diode (LED) light source, said circuit comprising:

a frequency controller operable for receiving a first dimming signal for controlling power of said LED light source to achieve a predetermined brightness and for further generating a second dimming signal having a frequency outside at least one predetermined range according to said first dimming signal when a frequency of said first dimming signal is within said at least one predetermined range; and a switch module coupled to said frequency controller and operable for switching on and off alternately to achieve said predetermined brightness according to said second dimming signal when the frequency of said first dimming signal is within said at least one predetermined range and according to said first dimming signal when the frequency of said first dimming signal is outside said at least one predetermined range.

2. The circuit as claimed in claim 1, wherein said first dimming signal and said second dimming signal comprise pulse width modulation signals, and wherein duty cycles of said first and second dimming signals are the same.

3. The circuit as claimed in claim 1, wherein said frequency controller comprises:

a frequency converter operable for generating said second dimming signal by multiplying a cycle period and a TON period of said first dimming signal by the same number.

4. The circuit as claimed in claim 3, wherein said number is adjustable according to the frequency of said first dimming signal.

5. The circuit as claimed in claim 1, wherein said frequency controller comprises a frequency converter operable for counting the number of cycles of a first sample clock signal to obtain result data indicative of the cycle period and the duty cycle of said first dimming signal, and for counting the number of cycles of a second sample clock signal according to said result data to generate said second dimming signal.

6. The circuit as claimed in claim 5, wherein the frequency of said second dimming signal is a fraction of the frequency of said first dimming signal, and wherein said fraction is determined by a ratio of the frequency of said second sample clock signal to the frequency of said first sample clock signal.

7. The circuit as claimed in claim 5, wherein said frequency converter comprises:

a pair of count modules operable for alternately counting the number of cycles of said first sample clock signal and counting the number of cycles of said second sample clock signal.

8. The circuit as claimed in claim 5, wherein said frequency converter comprises:

a first count module operable for counting the number of cycles of said first sample clock signal and for storing said result data in a register; and a second count module coupled to said register and operable for counting the number of cycles of said second sample clock signal to generate said second dimming signal.

9. The circuit as claimed in claim 1, further comprising:

a power converter coupled to said LED light source and operable for converting a first direct current (DC) voltage to a second DC voltage to drive said LED light source; and a logic module coupled to said power converter and said frequency controller and operable for detecting said switch module based on said first and second dimming signals and for terminating an operation of said power converter when said switch module is switched off.

10. A method for driving a light emitting diode (LED) light source, said method comprising:

receiving a first dimming signal for controlling said LED light source to achieve a predetermined brightness;

generating a second dimming signal having a frequency outside at least one predetermined range according to said first dimming signal when the frequency of said first dimming signal is within said at least one predetermined range;

controlling said LED light source to achieve said predetermined brightness according to said second dimming signal when the frequency of said first dimming signal is within said at least one predetermined range; and controlling said LED light source to achieve said predetermined brightness according to said first dimming signal when the frequency of said first dimming signal is outside said at least one predetermined range.

11. The method as claimed in claim 10, further comprising:

converting a first direct current (DC) voltage to a second DC voltage to drive said LED light source by a power converter; and terminating an operation of said power converter according to said first and second dimming signals.

12. The method as claimed in claim 10, further comprising:

maintaining duty cycles of said first dimming signal and said second dimming signal to be the same, wherein said first dimming signal and said second dimming signal comprise pulse-width modulation signals.

13. The method as claimed in claim 10, further comprising:

multiplying the cycle period of said first dimming signal and a TON period of said first dimming signal by the same number to generate said second dimming signal.

14. The method as claimed in claim 13, further comprising:

adjusting said number according to the frequency of said first dimming signal.

15. The method as claimed in claim 10, further comprising:

counting the number of cycles of a first sample clock signal to obtain result data indicative of a cycle period and a duty cycle of said first dimming signal; and counting the number of cycles of a second sample clock signal according to said result data to generate said second dimming signal, wherein the frequency of said second dimming signal is a fraction of the frequency of said first dimming signal, and wherein said fraction is determined by a ratio of the frequency of said second sample clock signal to the frequency of said first sample clock signal.

16. A controller for controlling dimming of a light emitting diode (LED) light source, said controller comprising:

a frequency controller operable for receiving a first dimming signal for controlling power delivered to said LED light source to achieve a predetermined brightness, for generating a second dimming signal having a frequency outside at least one predetermined range according to said first dimming signal when a frequency of said first dimming signal is within said at least one predetermined range, and for alternately turning on and off a switch coupled to said LED light source to achieve said predetermined brightness according to a selected dimming signal, wherein said selected dimming signal comprises said first dimming signal when the frequency of said first dimming signal is outside said at least one predetermined range and comprises said second dimming signal when the frequency of said first dimming signal is within said at least one predetermined range; and a logic module coupled to said frequency controller and operable for detecting said selected dimming signal and for terminating an operation of a power converter when said selected dimming signal indicates said switch is turned off, wherein said operation of said power converter comprises providing a voltage to drive said LED light source.

17. The controller as claimed in claim 16, wherein said power converter comprises a converter selected from the group consisting of: a buck converter, a boost converter, a buck-boost converter, and a flyback converter.

18. The controller as claimed in claim 16, wherein said first dimming signal and said second dimming signal comprise pulse width modulation signals, and wherein duty cycles of said first and second dimming signals are the same.

19. The controller as claimed in claim 16, wherein said frequency controller comprises a frequency converter operable for counting the number of cycles of a first sample clock signal to obtain result data indicative of the cycle period and the duty cycle of said first dimming signal, and for counting the number of cycles of a second sample clock signal according to said result data to generate said second dimming signal.

20. The controller as claimed in claim 19, wherein the frequency of said second dimming signal is a fraction of the frequency of said first dimming signal, and wherein said fraction is determined by a ratio of the frequency of said second sample clock signal to the frequency of said first sample clock signal.

* * * * *